US009222752B2

(12) United States Patent
Kingsbury et al.

(10) Patent No.: US 9,222,752 B2
(45) Date of Patent: Dec. 29, 2015

(54) LIGHT GATHERING ADJUSTABLE BALLISTIC RETICULE

(71) Applicants: Klint M. Kingsbury, Austin, TX (US); Clayton W. Reinarz, New Braunfels, TX (US)

(72) Inventors: Klint M. Kingsbury, Austin, TX (US); Clayton W. Reinarz, New Braunfels, TX (US)

( * ) Notice: Subject to any disclaimer, the term of this patent is extended or adjusted under 35 U.S.C. 154(b) by 0 days.

(21) Appl. No.: 13/936,105

(22) Filed: Jul. 5, 2013

(65) Prior Publication Data

US 2014/0160475 A1 Jun. 12, 2014

Related U.S. Application Data

(60) Provisional application No. 61/668,272, filed on Jul. 5, 2012.

(51) Int. Cl.
*F41G 1/00* (2006.01)
*F41G 1/34* (2006.01)

(52) U.S. Cl.
CPC ..... *F41G 1/345* (2013.01)

(58) Field of Classification Search
CPC ..... F41G 1/00; F41G 1/467; F41G 1/30; F41G 1/345; F41G 1/14; F41G 3/06; G02B 2027/0198; G02B 27/64
USPC ..... 356/153, 251, 252; 33/265, 297; 359/424, 428; 42/113, 123, 145, 118, 42/130, 90, 122, 127
See application file for complete search history.

(56) References Cited

U.S. PATENT DOCUMENTS

| | | | | |
|---|---|---|---|---|
| 3,320,671 | A | 5/1967 | Rickert et al. | |
| 4,030,203 | A | 6/1977 | Ackerman, Jr. | |
| 4,722,601 | A * | 2/1988 | McFarlane | 356/141.3 |
| 5,065,520 | A | 11/1991 | Shimizu et al. | |
| 5,090,805 | A | 2/1992 | Stawarz | |
| 5,144,479 | A | 9/1992 | Aharon et al. | |
| 7,100,319 | B2 | 9/2006 | Paige | |
| 7,434,345 | B2 | 10/2008 | Verdugo | |
| 7,814,669 | B2 * | 10/2010 | Kingsbury | 33/265 |
| 8,006,395 | B2 * | 8/2011 | Kingsbury | 33/265 |
| 8,099,874 | B2 * | 1/2012 | Priebe | 33/265 |
| 2004/0076928 | A1 | 4/2004 | Renntoft | |
| 2010/0064535 | A1 * | 3/2010 | Kingsbury | 33/265 |
| 2012/0180329 | A1 * | 7/2012 | Priebe | 33/265 |
| 2015/0068098 | A1 * | 3/2015 | Stokes et al. | 42/118 |

* cited by examiner

*Primary Examiner* — Hoa Pham
(74) *Attorney, Agent, or Firm* — Kammer Browning PLLC

(57) ABSTRACT

A weapon sighting system for gathering ambient or generated light and projecting a fixed or adjustable ballistic reticule image for targeting. The system includes a partially reflective, zero parallax, optical lens assembly, an illuminating reticule projection component, and an adjustable bracket fixed to the weapon being sighted. The bracket supports the lens assembly at one end and the projection component at an opposing end. The projection component is aligned to project a light image onto the lens assembly to be reflected back into the target sightline. The projection component gathers ambient (or generated) light through polymer acrylic solid materials and/or fiber optics, and directs the light through a fixed or adjustable mask. The movement of the weapon effects a corresponding movement in the angle of reflection through the optics of the sighting system. An adjustable mask allows the projected image to change to accommodate near and distant targets.

1 Claim, 11 Drawing Sheets

LIGHT GATHERING ADJUSTABLE BALLISTIC RETICULE

CROSS REFERENCES TO RELATED APPLICATIONS

This application claims the benefit under Title 35 United States Code §119(e) of U.S. Provisional Patent Application Ser. No. 61/668,272, filed Jul. 5, 2012, the full disclosure of which is incorporated herein by reference.

BACKGROUND OF THE INVENTION

1. Field of the Invention

The present invention relates generally to sighting mechanisms for use in conjunction with archery bows and other subsonic weaponry, such as paintball guns, grenade launchers, and the like, as well as with some higher velocity firearms. The present invention relates more specifically to a sighting system that uses an illuminated ballistic reticule to facilitate the aiming of a ballistic projectile launching device (a bow, a rifle, etc.) at targets over a variety of distances.

2. Description of the Related Art

A number of devices have been developed to facilitate the aiming of an archery bow or other ballistic weapon at a target positioned over a range of distances from the archer or shooter. The nature of archery, for example, is such that relatively small variations in distance to a target require relatively significant variations in the angle at which the archer holds the bow and aims towards the target. Whereas a distance of one hundred yards may merit little change in the aiming angle for a rifle, such distance variations in archery require a much more significant change in the aiming angle. Sighting devices designed for rifles do not generally translate well into sights suitable for bows.

The present invention provides a novel mechanism for illuminating a ballistic reticule that may be projected onto an optical aiming system such as that described in U.S. Pat. No. 8,006,395, issued Aug. 30, 2011, as well as U.S. Pat. No. 7,814,669 issued Oct. 19, 2010, the full disclosures of which are incorporated herein by reference. In place of the direct image fiber optic wave guides disclosed and described in the above cited references, the present invention provides a full reticule configuration that utilizes the gathering of ambient light (or alternately, light from an artificial source) through a polystyrene component and directs this light through a cut out mask projecting it to a partially reflective, zero parallax optical array being utilized within the sighting system. In this manner, the movement of the bow or other device effects a corresponding movement in the angle of reflection through the optics of the sighting system. The structure of the ballistic reticule is such as to accommodate angle movements and twisting movements and to reflect the same within the sighting optics.

SUMMARY OF THE INVENTION

The present invention therefore provides a weapon sighting system for gathering ambient or generated light and projecting a fixed or adjustable ballistic reticule image for targeting. The system includes a partially reflective, zero parallax, optical lens assembly, an illuminating reticule projection component, and an adjustable bracket fixed to the weapon being sighted. The bracket supports the lens assembly at one end and the projection component at an opposing end. The projection component is aligned to project a light image onto the lens assembly to be reflected back into the target sightline. The projection component gathers ambient (or generated) light through polymer acrylic solid materials and/or fiber optics, and directs the light through a fixed or adjustable mask. The movement of the weapon effects a corresponding movement in the angle of reflection through the optics of the sighting system. An adjustable mask allows the projected image to change to accommodate near and distant targets. The system therefore provides a sighting mechanism that utilizes an ambient light gathering structure to direct light through a specifically configured ballistic reticule mask (fixed or adjustable) onto the partially reflective, zero parallax surfaces of the optics of the sighting system. The sighting mechanism provides a fixed mask in some embodiments and an adjustable mask in alternate embodiments.

DETAILED DESCRIPTION OF THE PREFERRED EMBODIMENTS

Figure 1:
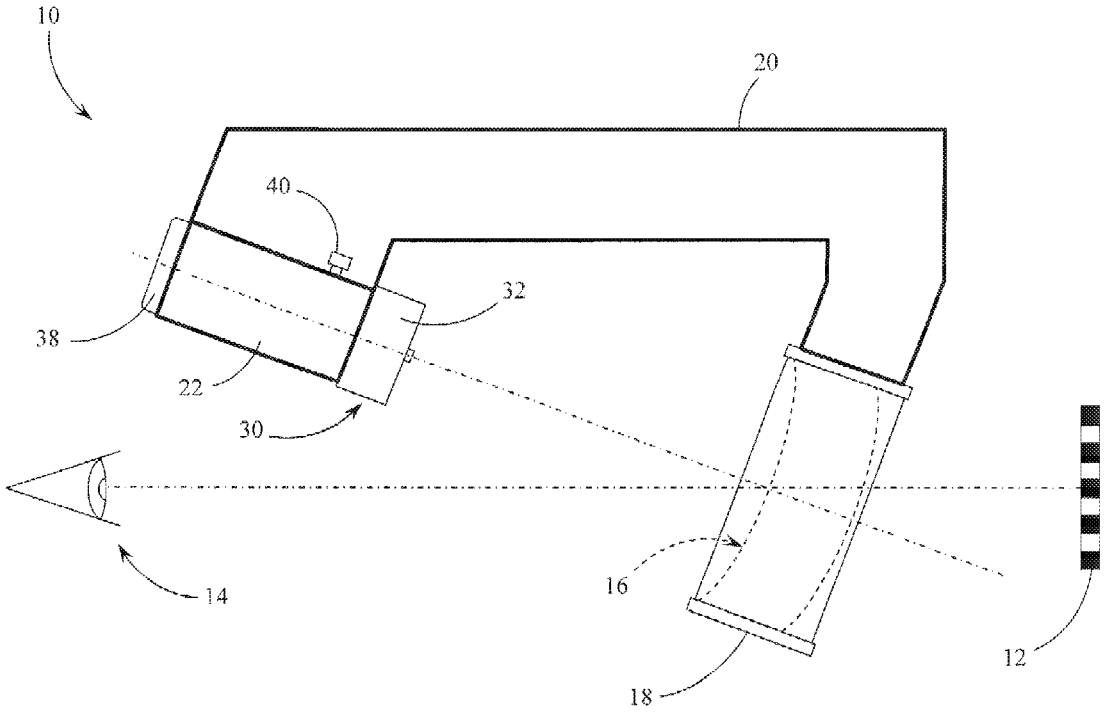
FIG. 1 is a side plan view of the preferred embodiment of the present invention disclosing a sighting system incorporating the polystyrene generated ballistic reticule structure improvement of the present invention.

Reference is made first to FIG. 1 for a description of the overall sighting system incorporating the improved reticule projecting component of the present invention. FIG. 1 is a side plan view of the preferred embodiment of the sighting system of the present invention. In this view, sighting system 10 is shown to include three basic components; the illuminating reticule structure, the partially reflective optical sighting structure, and a connecting support bracket. This system is positioned generally as shown with a target 12 oriented at a distance opposite the optical components from the archer's eye 14. In this manner, the archer may sight through the optical system to the target 12 and then make adjustments in the angle of the ballistic projectile device prior to shooting or firing.

The sighting system 10 of the present invention includes sighting ring 18 which positions and holds an array of partially reflective, zero parallax optical lenses 16. This optical system is connected through a primary bracket 20 to an illuminating reticule holder 22. Removably positioned within holder 22 is illuminating ballistic reticule 30 which includes polystyrene cylinder 38 and reticule mask cap 32. Illuminating ballistic reticule 30 is held within holder 22 by way of set screw 40. Reticule mask cap 32 is held onto polystyrene cylinder 38 with attachment screws 34 in a manner described in more detail below.

Figure 2:
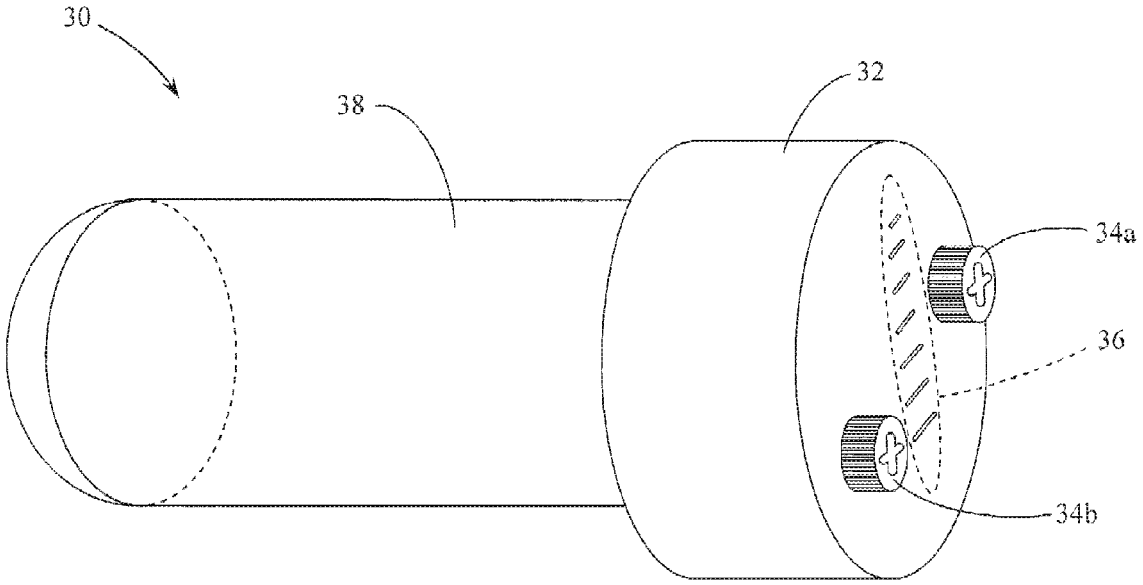
FIG. 2 is a perspective view of the polystyrene ballistic reticule component and reticule mask component of the sighting system of the present invention.

Reference is now made to FIG. 2 for a detailed description of the structure of the improved reticule projecting component of the present invention. Ballistic reticule projecting component 30 is generally comprised of polystyrene cylinder 38 having a light gathering end designed to extend out from reticule holder 22 as shown in FIG. 1. Both the end face and the sides of polystyrene cylinder 38 serve to collect ambient light to project through the reticule projecting component.

At an opposite end of polystyrene cylinder 38 is positioned reticule mask cap 32 which comprises a metal cylindrical component open on one end and sized to receive the cylindrical structure of polystyrene component 38. A flat face of polystyrene component 38 is inserted into the open cylindrical mask cap 32 up to the point where it contacts the internal face of the cap. On the end face of mask cap 32 are configured a number of openings and apertures that both create the image for the ballistic reticule and serve to secure the polystyrene component within the cap. These include apertures to receive attachment screws 34*a* and 34*b* as well as projection apertures 36 described in more detail below.

Figure 3:
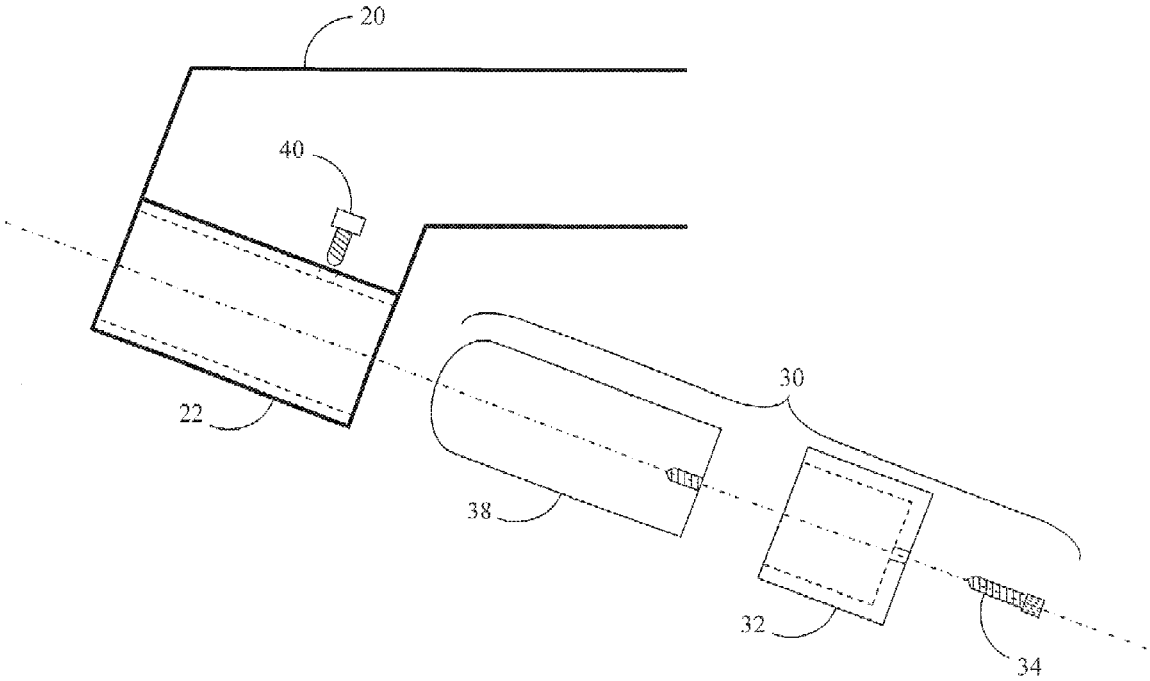
FIG. 3 is a side view of the exploded assembly of the preferred embodiment of the present invention showing the manner in which the components are assembled into the sighting system.

Reference is next made to FIG. 3 which provides an exploded assembly view of the components of the system of the present invention as they would be assembled onto the bracket structure of a sighting system for a bow (as an example). Primary bracket 20 is again shown to terminate in illuminating reticule holder 22 which, in the preferred embodiment, is a cylindrical holder that receives and retains the illuminating reticule projection component 30. Reticule projection component 30 is again shown to be made of polystyrene cylinder 38, reticule mask cap 32, and a number of attachment screws 34 which extend through apertures in reticule mask cap 32 into tapped holes in polystyrene cylinder 38. The assembled reticule projecting component 30 slides into the cylindrical structure of holder 22 and is fixed in place using set screw 40.

Figure 4:
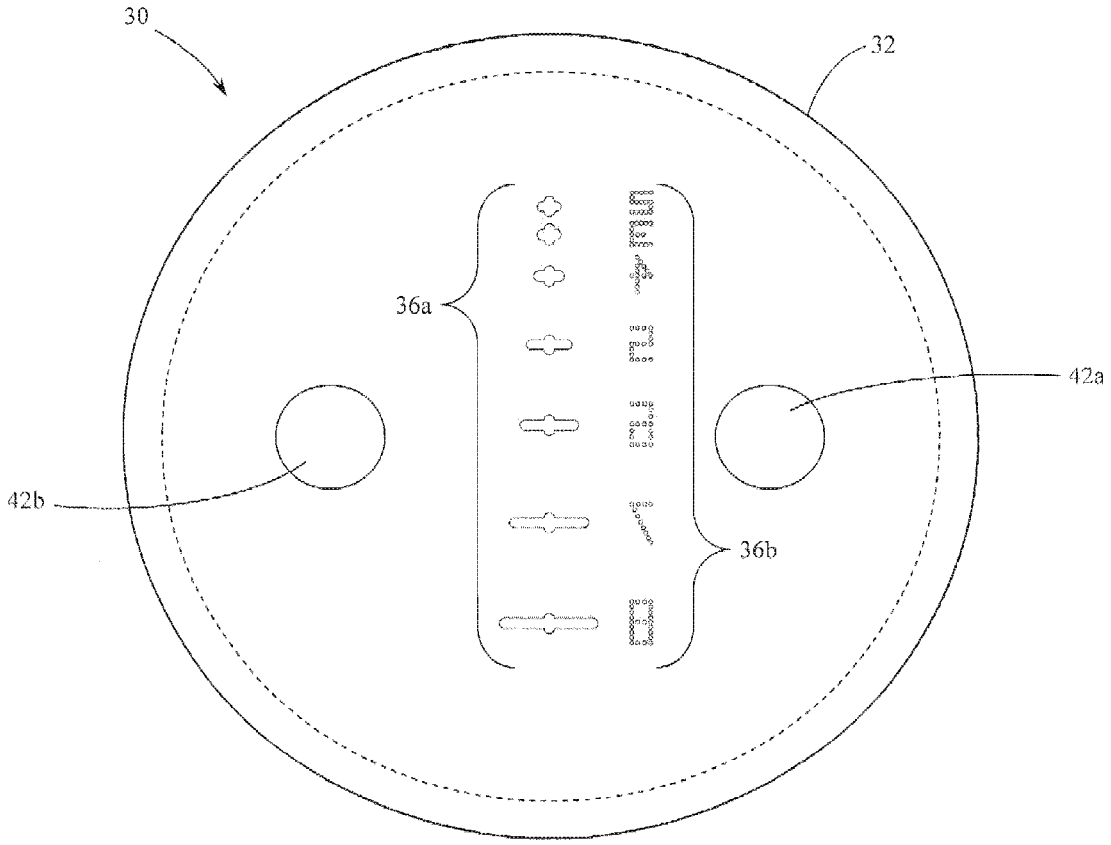
FIG. 4 is a front profile view of the reticule mask component of the system of the present invention showing the cutouts for transmitting light through the mask.

Reference is next made to FIG. 4 which is a front profile view of the reticule mask cap 32 of the reticule projecting component 30 of the present invention. FIG. 4 discloses apertures 42*a* and 42*b* which are positioned to receive attachment screws (not shown) to fix mask cap 32 to the polystyrene cylinder (not shown). In addition to these attachment apertures, a plurality of smaller, fine resolution apertures are cut (such as with a laser or high pressure fluid) through the front wall face of mask cap 32 to provide the mask for the reticule display to be projected onto the optical components of the system of the present invention. In general, these apertures comprise an array of elliptical "cross hairs" 36*a* and an associated set of reference numerals 36*b*. The numerals 36*b*, of course, appear in reverse in this view in order to project obverse images onto the partially reflective optical components of the system.

Figure 5:
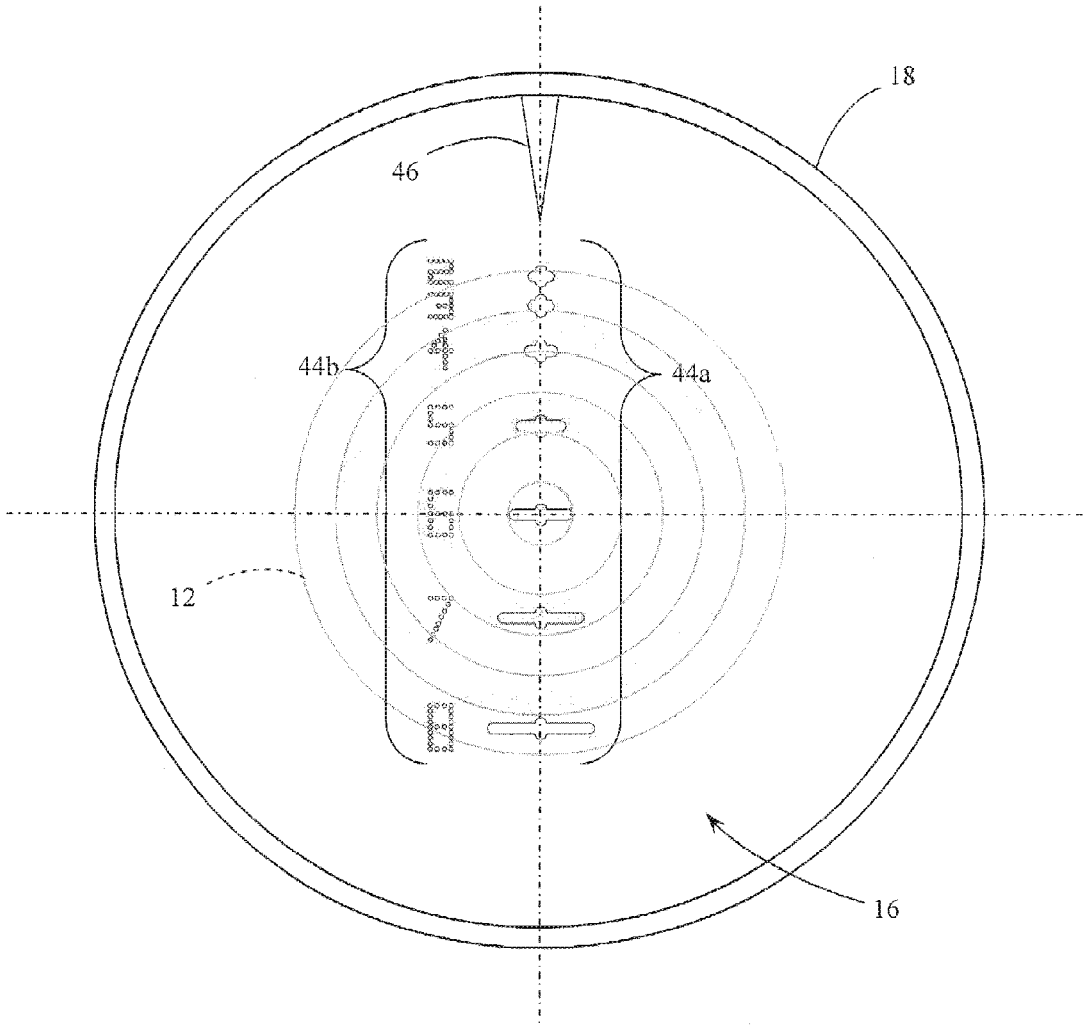
FIG. 5 is a front profile view of the view through the sighting system of the present invention showing the manner in which the projected images appear on the partially reflective, zero parallax optics of the sighting system.

Reference is finally made to FIG. 5 which shows the view that the user might see into the optical sighting components of the system of the present invention wherein the reticule has been projected onto the optics by the illuminating reticule mask. In the view of FIG. 5, optic cylinder 18 is shown to hold optic lenses 16 which, as indicated above, provide a partially reflecting, zero parallax surface to convey the image to the user to facilitate sighting of the projectile device. As projected onto the optics, the reticule image comprises an obverse projection of the numerals 44*b* positioned adjacent a projection of the array of "cross hairs" 44*a*. Additionally positioned within the optical system of the present invention is reference indicator 46 which facilitates a proper angular orientation of the projectile device.

In summary, established through the face of the mask cap are the image apertures necessary to create the ballistic reticule image onto the partially reflective, zero parallax optical sighting system. In the preferred embodiment, the reticule is comprised of a plurality of aperture slits ("cross hairs") of varying width that assist with the range sighting with the system. Adjacent each of the slits is a mirror image (in the profile view of FIG. 4) of a numeral from 2 through 8 to provide the user with a numerical reference for each of the range sighting slits. The image thus presented to the user on the partially reflective surface of the optical sighing system shows the numerical representations as normal images of the numbers associated and positioned next to each of the appropriate sighting slits.

Figure 6:
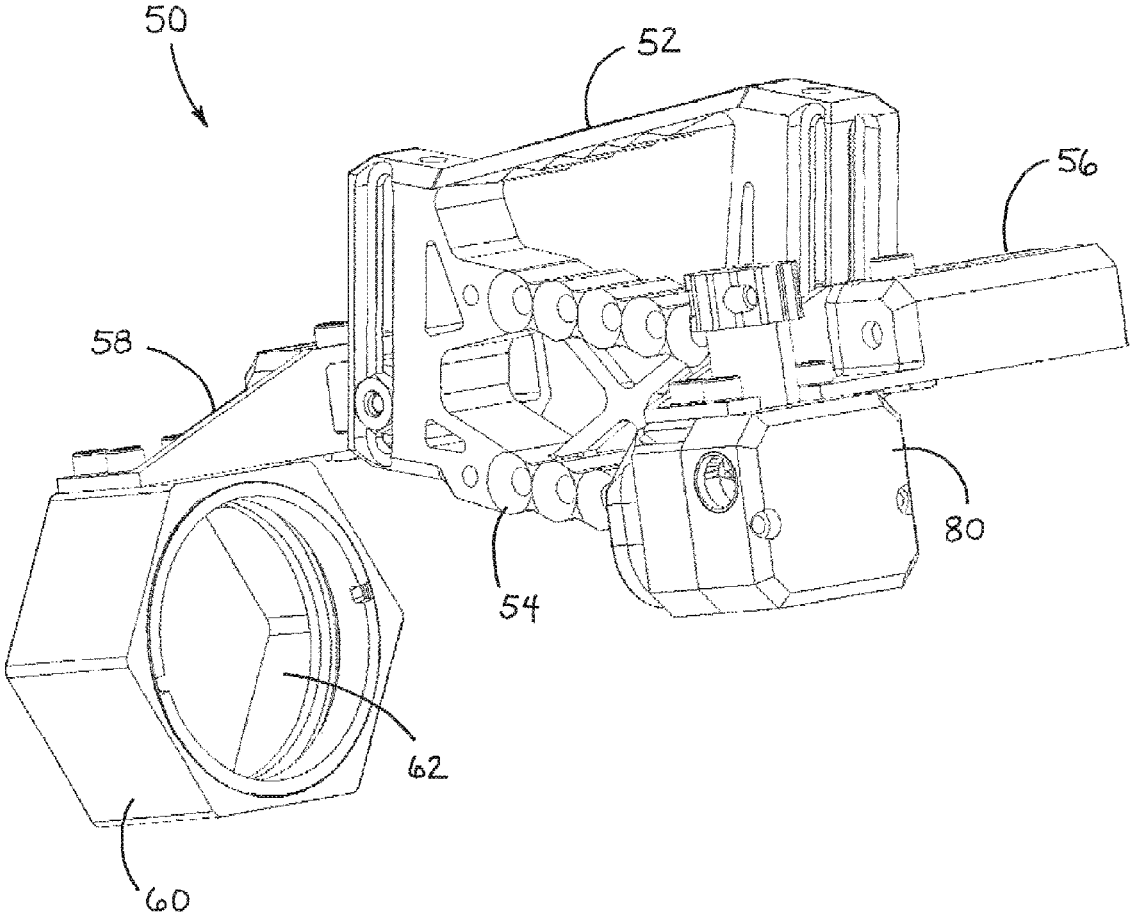
FIG. 6 is a perspective view of the implementation of an alternate embodiment of the ballistic reticule projection assembly for the sighting system of the present invention.
Figure 7:
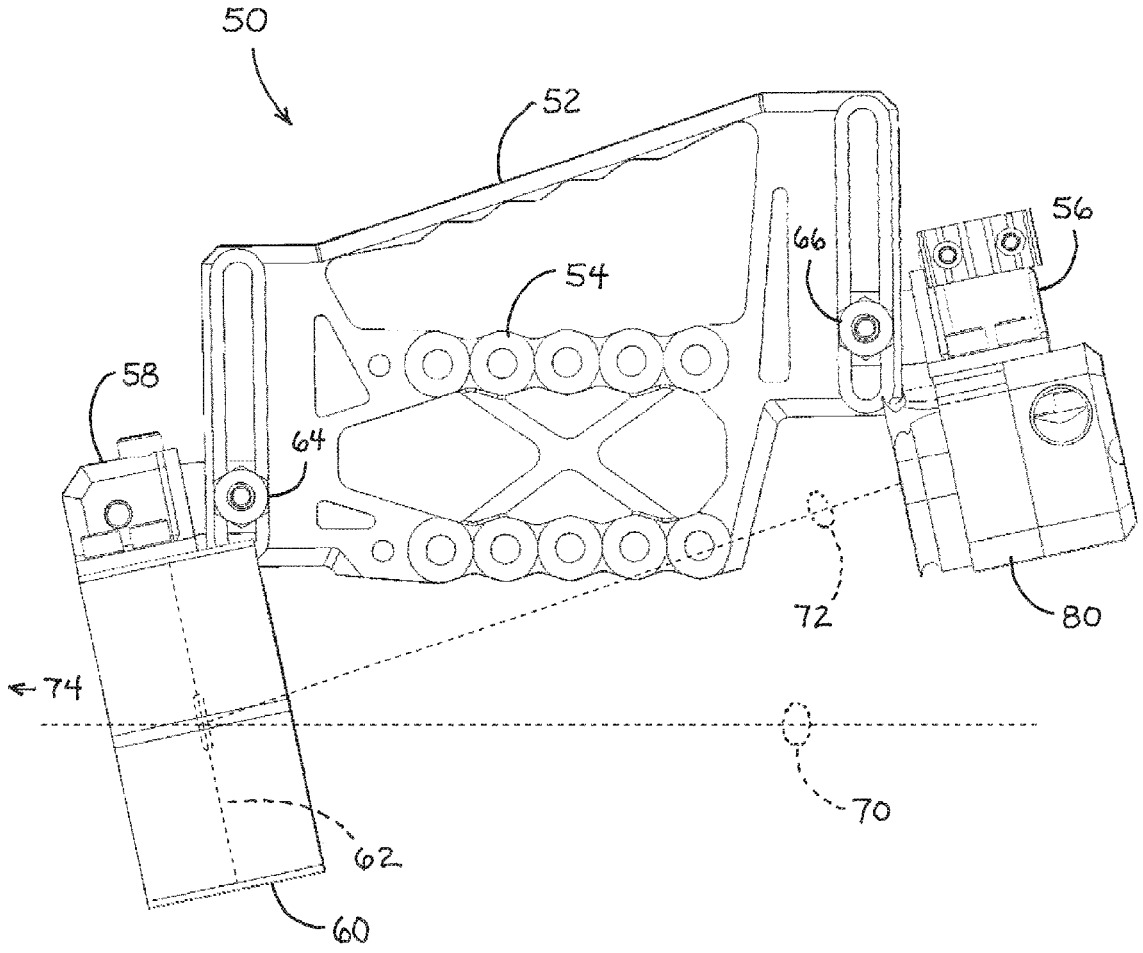
FIG. 7 is a side plan view of the implementation of the alternate embodiment of the present invention shown in FIG. 6.

Reference is next made to FIGS. 6 & 7 for a detailed description of an alternate preferred embodiment of the sighting system of the present invention. Sighting system 50 is shown to include similar basic components, namely the illuminating reticule structure 80, the partially reflective optical sighting structure 60, and a connecting support bracket 52. The optical sighting structure 60 is adjustably connected to the bow (or other weapon) by way of adjustable optics bracket 58. Positioned within partially reflective optical sighting structure 60 is zero parallax optical lens structure 62. Connecting support bracket 52 is mounted to the bow (in this case) by way of mounting apertures 54. Extending from the rearward section of connecting support bracket 52 is illuminating reticule structure support bracket 56.

By reference to FIG. 7, the alignment and sight paths of the various components of the system 50 are shown in greater detail. Again, optical sighting structure 60 is connected to support bracket 52 by way of adjustable optics bracket 58. Set screw 64 allows for the gross adjustment of optical sighting structure 60 with respect to connecting support bracket 52 and therefore, with respect to the bow or weapon. In a similar manner, the illuminating reticule structure 80 held by adjustable reticule structure support bracket 56 may be grossly adjusted with respect to connecting support bracket 52 by way of set screw 66. These gross adjustments with respect to the fixed central connecting support bracket 52 allow the user to properly align and roughly sight the respective components of the sighting system. The user sights along sight line 70 towards target 74, and not only views target 74 through lens 62, but also views the reflective image presented by illuminating reticule structure 80 by way of image line 72 being reflected back to the user from lens 62. In this manner, the user views both the target and the adjustable reticule image created by the illuminating reticule structure 80 (described in more detail below).

Figure 8:
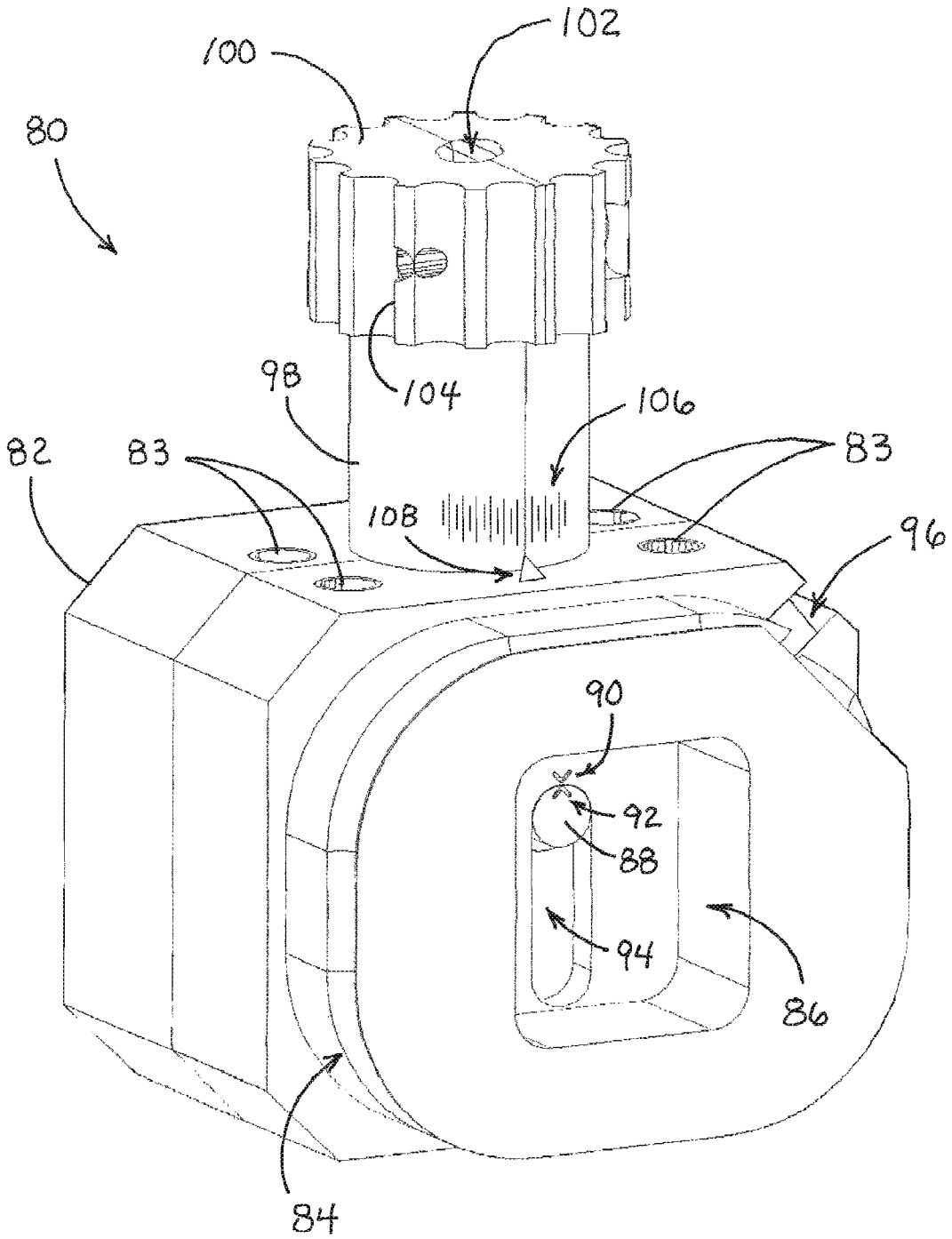
FIG. 8 is a detailed perspective view of the adjustable ballistic reticule system of the alternate embodiment of the present invention shown in FIG. 6.
Figure 9:
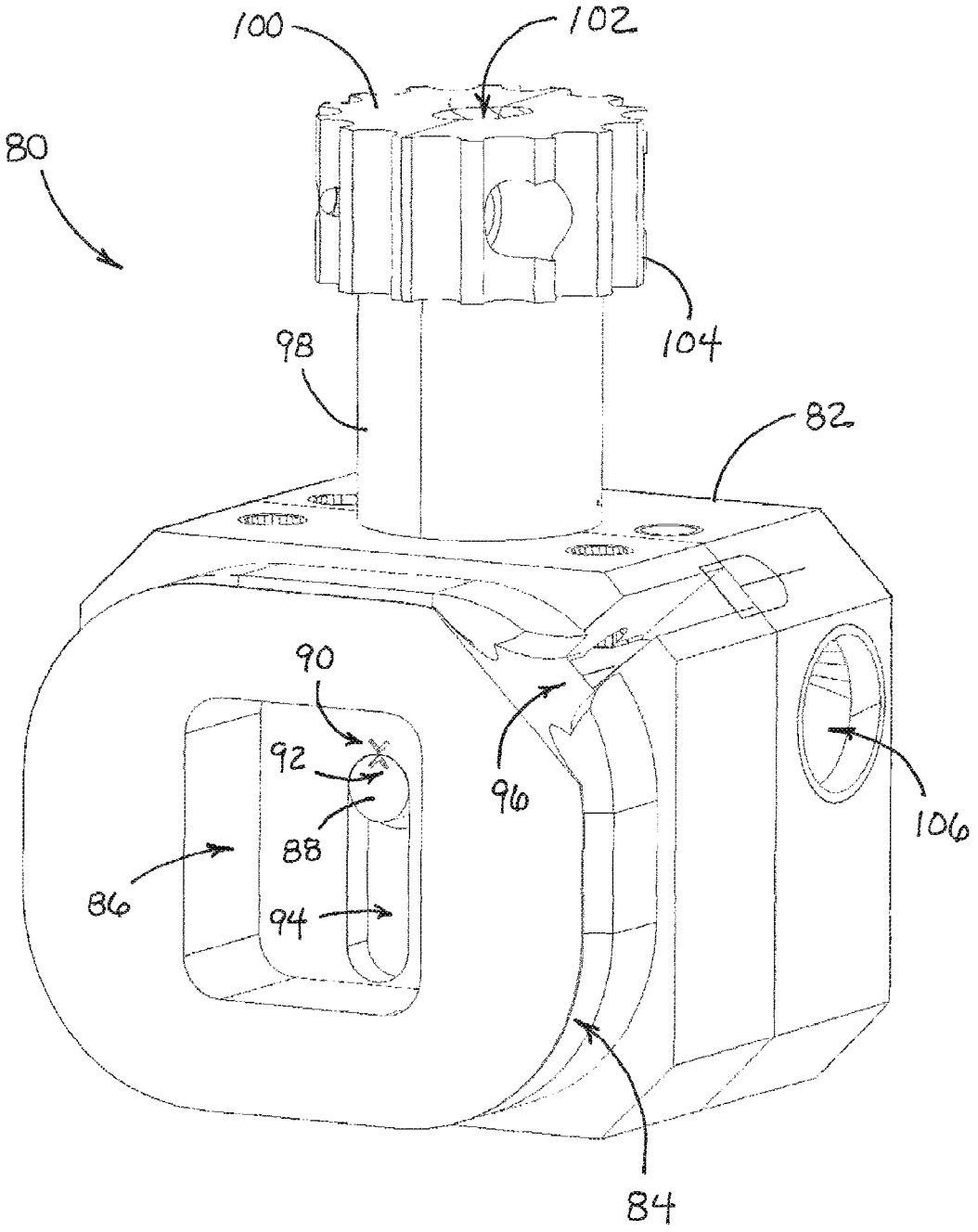
FIG. 9 is a second angle detailed perspective view of the adjustable ballistic reticule system of the alternate embodiment of the present invention shown in FIG. 6.

Reference is next made to FIGS. 8 & 9 for a detailed description of the alternate preferred embodiment of the illuminating reticule structure of the present invention. In place of the solid polystyrene cylinder with mask, this alternate embodiment provides an adjustable image generating assembly that relies on ambient light (or in a further alternate embodiment, a generated LED light) to provide and project an image onto the partially reflective, zero parallax optical lens assembly of the system. As shown in FIGS. 8 & 9 this application of the adjustable illuminating component is one that is structured for a bow. The same principles shown in FIGS. 8 & 9 for the illuminating reticule structure could be implemented in conjunction with other firearms, such as rifles and grenade launchers, wherein the adjustment component (the adjustment knob or the like) would preferably be positioned at right angles to that shown with the bow embodiment of FIGS. 8 & 9.

The basic structure of illuminating ballistic reticule 80 comprises a housing 82 that positions and encloses a number of components and light wave guides, some of which are adjustable, to provide for the projection of a light image towards the partially reflective lens of the sighting system. On the lens facing side of housing 82 is light gathering spool 84 which, in the preferred embodiment, provides a spool onto which a quantity of fiber optic light gathering material may be wound for the purpose of gathering ambient light and directing it into the interior of housing 82 in a manner described in more detail below. The overall structure of the illuminating ballistic reticule 80 is attached to the support bracket 56 (shown in FIGS. 6 & 7) by way of bolt holes 83.

Centrally positioned, again on the lens side of the illuminating ballistic reticule 80, within the face of the housing 82 and surrounded by spool 84 is projection aperture 86. Within projection aperture 86 are the various components that provide the mask through which the illuminating light forming the ballistic reticule image is generated. These components essentially comprise adjustable cylinder 88 and elongated circular slot 94. Positioned on the face of adjustable cylinder 88 is a chevron or inverted "V" mask 92 that allows for the passage of light from within cylinder 88 through the mask to form a chevron shaped light image. Matching in size but opposing in orientation is chevron or "V" mask 90 fixed in position through the base face of aperture 86. The movement of adjustable cylinder 88 within elongated circular slot 94 opens a gap between the opposing points of chevron masks 90 & 92, a gap that may be adjusted by the user depending upon the distance to the target that is being sighted and the type of weapon that is being used.

Shown more completely in FIG. 9 is fiber optic port 96 which guides the ends of the fiber optic light gathering material wound on spool 84 into the interior of housing 82 where the fiber optic wave guides (at least two fiber optics in the preferred embodiment) terminate behind each of the two sighting chevron masks 90 & 92. A first fiber optic wave guide terminates behind chevron mask 92 within cylinder 88. A second fiber optic wave guide terminates behind chevron mask 90, again through an aperture or channel fixed within the material from which housing 82 is constructed. Additional detail regarding the manner in which these fiber optic wave guide components are positioned is provided below.

Cylinder 88 is adjustable vertically within elongated circular slot 94 by means of rotatable adjustment knob 100. Knob 100 is connected through the wall of housing 82 by way of rotatable cylindrical shaft 98. The knurled edge 104 of knob 100 allows the user to accurately and incrementally rotate the knob so as to incrementally adjust the separation between chevron masks 90 & 92. Cylinder 88 represents the exposed face of a right angled movable structure shown in detail in FIG. 10. Reference indicator lines 106 may be placed on rotating shaft 98 and referenced against pointer 108 fixed on housing 82 so that the user may establish a pre-set reference for the appropriate adjustment for the variable gap between chevron masks 90 & 92.

Figure 10:
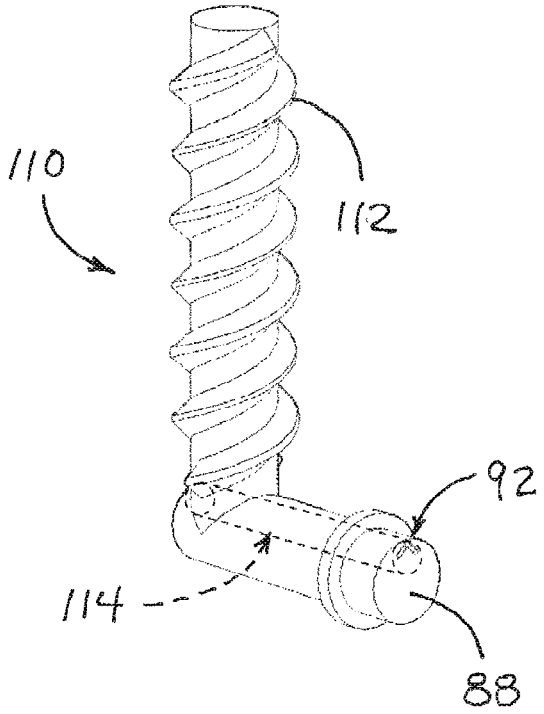
FIG. 10 is a detailed perspective view of the adjustable component of the alternate embodiment of the sighting system of the present invention shown in FIGS. 8 & 9.

FIG. 10 shows in greater detail a perspective view of the internal adjustable component 110 of the system shown from the outside in FIGS. 8 & 9. In this view, adjustable cylinder 88 incorporating chevron mask 92 on its lens facing face is shown to be part of the overall right angle component 110 that incorporates a second cylindrical section connected at right angles to adjustable cylinder 88. The upper (right angle) cylindrical portion of internal adjustable component 110 incorporates threads 112 that mate with and interact with internal threads within the aperture 102 positioned in adjustment shaft 98 shown in FIGS. 8 & 9. A cylindrical channel 114 is drilled through cylinder 88 to provide a conduit for one of the two fiber optic wave guides brought into the enclosure as described above. The wave guide (fiber optic) is positioned through channel 114 to terminate directly behind chevron mask 92 so that the light carried by the wave guide projects through chevron mask 92 towards the partially reflective lens of the overall sighting system. By turning adjustment knob 100 (FIGS. 8 & 9) the adjustable component 110 shown in FIG. 10 moves vertically within the slot of the image projecting face of the system, thereby adjustably separating the two chevron images projected onto the lens.

Figure 11A:
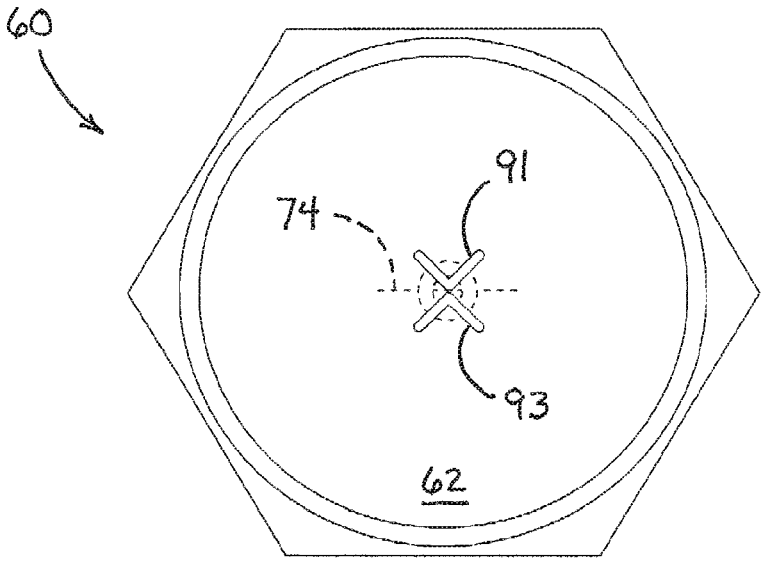
FIGS. 11A-11C are elevational plan sight views of the alternate embodiment of the sighting system of the present invention showing the projected image on the sight lens for near target, low velocity (FIG. 11A), distant target, low velocity (FIG. 11B), and distant target, high velocity (FIG. 11C) weapons.
Figure 11B:
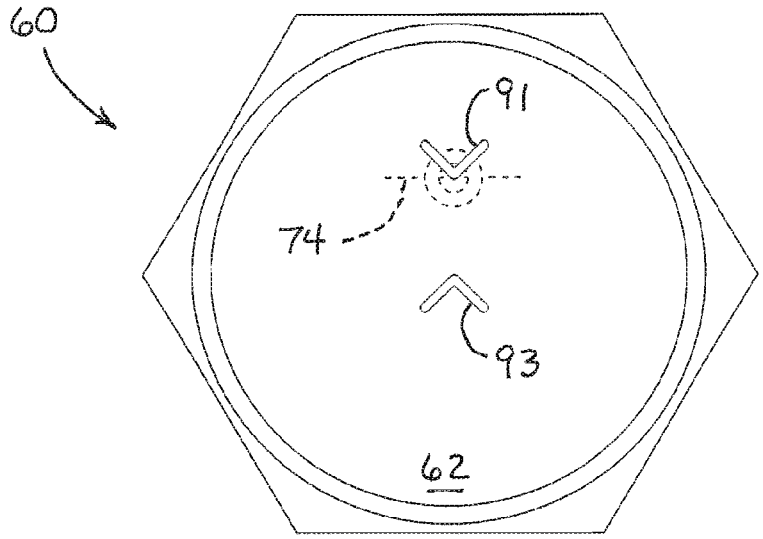
Figure 11C:
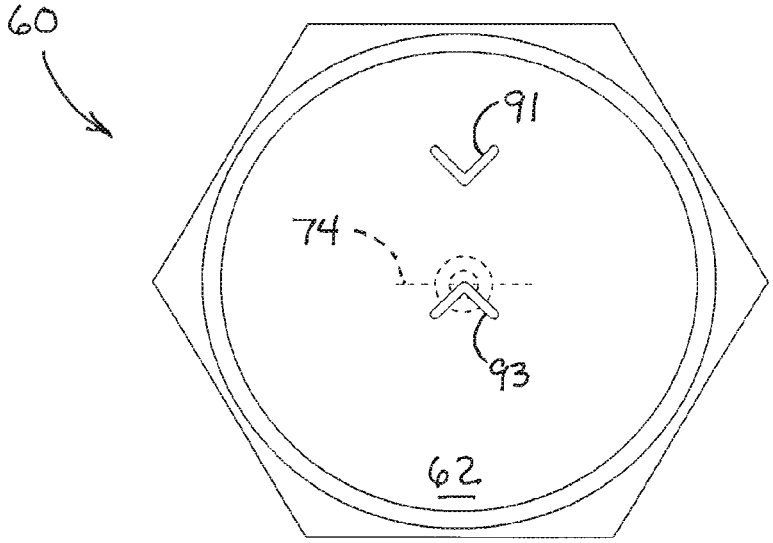

Reference is finally made to FIGS. 11A-11C which provide three variations on the view of the user in conjunction with various distance and weapon velocity settings, all through the partially reflective zero parallax optical lens system of the present invention fixed with the alternate preferred embodiment of the invention. In the views presented, lens assembly holder 60 is shown to surround and fix partially reflective, zero parallax, optical lens assembly 62. The reflected images 91 & 93 of the illuminating chevron shaped reticules are shown in various positions on the reflective lens 62.

In the first view of FIG. 11A, a target (represented by the dashed line image 74 shown) that is close to the user would be sighted by way of drawing the chevron shaped projections 91 & 93 together to a point. This thereby presents a typical sighting "X" that the user may position over the target for nearby objects. FIG. 11B represents the use of the system in conjunction with a distant target (in archery or with a lower velocity projectile such as a grenade launcher as examples) whereby the target is positioned on the upper chevron aiming point 91, the user having adjusted the illuminating system for the yardage to the target in the manner described above. FIG. 11C represents a further use of the alternate preferred embodiment of the present invention on, for example, the combination of a higher and a lower velocity firearm assembly, whereby elevating the weapon to position the target behind the lower chevron image provides an accurate yardage sighting system for the lower velocity firearm while moving the weapon to position the target behind the upper chevron image (as in FIG. 11B) provides an accurate yardage sighting system for the higher velocity firearm.

Those skilled in the art will recognize that the system described should be grossly adjusted for the particular weapon it is to be used with and that the appropriate reference lines indicated on the knob adjustment shaft would provide accurate yardage indicators referenced to the specific weapon. Likewise, the user would know to reference either the top or bottom chevron shaped images within the sighting system depending upon the angle of sight appropriate for a target at a given yardage for a particular type of weapon. It will be recognized that the alternate embodiment of the present invention as described has application not only to archery bow sights, but also to lower velocity firearm weapons such as grenade launchers and the like, and to higher velocity firearm weapons such as rifles, as long as the appropriate gross adjustments are made and the appropriate reference lines are provided.

Although the present invention has been described in connection with a number of preferred embodiments, and in conjunction primarily with archery sights and the like, those skilled in the art will recognize that minor modifications to the structures of the systems described (primarily with regard to the support brackets and adjustment components) would allow for implementation of the basic concepts of the system of the present invention in conjunction with a wide variety of lower and higher velocity weapons and weapon sights. In addition, the present invention has been described in conjunction with a few specific reticule formats, one adjustable and one fixed. Those skilled in the art will recognize that alternate reticule formats incorporating different shaped indicators and different types of adjustable separations between indicators, may be utilized with application of the same basic concepts of the invention as described. Each of these alternate embodiments and alternate applications of the system of the present invention are anticipated and are defined to fall within the spirit and scope of the invention as characterized by the appended claims.

We claim:

1. A weapon sighting system for gathering ambient or generated light and projecting an adjustable ballistic reticule image for targeting the weapon, the sighting system comprising:

a partially reflective, zero parallax, optical lens assembly positioned on a forward target side of the weapon sighting system within a sightline directed from a user to a target;

an illuminating reticule projection component positioned on a rearward user side of the weapon sighting system and providing a projection line offset from the sightline; and an adjustable bracket assembly fixed to the weapon being sighted, adjustably supporting the optical lens assembly at the forward target side thereof, and adjustably supporting the illuminating reticule projection component at the rearward user side thereof;

wherein the illuminating reticule projection component and the optical lens assembly may each be positioned on the adjustable bracket assembly and aligned so as to project a light image along the projection line onto the partially reflective optical lens assembly and thereby be reflected back into the target sightline of the user.

* * * * *